United States Patent [19]

Förster et al.

[11] 4,265,302

[45] May 5, 1981

[54] HEAT EXCHANGER

[75] Inventors: Siegfried Förster, Alsdorf; Manfred Kleemann, Quadrath-Ichnedorf; Axel Krauth, Selb; Horst R. Maier, Selb; Hans-Jürgen Pohlmann, Selb, all of Fed. Rep. of Germany

[73] Assignee: Rosenthal Technik AG & Kernforschungsanlage Julich GmbH, Fed. Rep. of Germany

[21] Appl. No.: 858,271

[22] Filed: Dec. 7, 1977

[30] Foreign Application Priority Data

Feb. 19, 1977 [DE] Fed. Rep. of Germany ..... 2707290

[51] Int. Cl.[3] ..... F28D 7/00

[52] U.S. Cl. ..... 165/165

[58] Field of Search..... 165/164, 5, 166, 4 R, 165/33, 31, 10, 157

[56] References Cited

U.S. PATENT DOCUMENTS

| | | | |
|---|---|---|---|
| 4,041,591 | 8/1977 | Noll et al. | 165/166 X |
| 4,098,330 | 7/1978 | Flower et al. | 165/166 |
| 4,109,710 | 8/1978 | Forster et al. | 165/166 X |
| 4,116,271 | 9/1978 | Lepeleire | 165/166 |

*Primary Examiner*—Samuel Scott
*Assistant Examiner*—Theophil W. Streule, Jr.
*Attorney, Agent, or Firm*—Ostrolenk, Faber, Gerb & Soffen

[57] ABSTRACT

A heat exchanger of a ceramic body, or the like, having a plurality of elongate flow passages in parallel relationship with the placement of the passages staggered with respect to the opposite end cover walls of the ceramic body, transversely extending parts of both cover walls being absent to expose those staggered passages that pass closer to the respective cover wall, thereby to permit access for fluid media to the flow passages; particular characteristic features of the passages are disclosed.

11 Claims, 5 Drawing Figures

HEAT EXCHANGER

The present invention relates to heat exchangers of ceramic material having a plurality of flow passages arranged side-by-side to allow heat to be transferred between different media flowing therethrough, and is particularly concerned to provide such heat exhangers which possess high heat exhange efficiency in relation to construction volume and weight, can be produced in simple manner and are of such design that thermal stresses may be substantially avoided.

According to the present invention, a heat exchanger comprises a ceramic body defining a plurality of elongate flow passages closed at their ends and arranged in a parallel staggered relationship to one another, one set of alternate passages extending along their lengths closer towards one cover wall, and the other set of alternate passages extending closer towards an opposed cover wall of the ceramic body, with at least two transversely-extending parts of each of said opposed pair of cover walls being absent to expose only that set of passages closer thereto, thus presenting a total of at least four openings for permitting, in use, two heat exchange media to flow through respective ones of said two sets of passages.

It has been found that the present heat exchanger achieves a high heat exhange efficiency in relation to construction volume and weight, such as hitherto known only for counter-current heat exchangers of folded thin sheet metal strips, and it is thought that the simply produced staggered arrangement of the flow passages is an important factor in this. It has also been found that if each of the cover walls presents three openings, one set of the passages having two inlets and a single outlet located therebetween, and the other set of the passages having two outlets and a single inlet located therebetween, the heat exchanger is then connectable to inlet and outlet conduits for the media in heat exchange in such a way that the occurrence of thermal stresses is largely avoided.

In order to achieve large heat exchange area per construction volume, the flow passages are advantageously formed as slots whose faces of major area overlap those of the slots adjacent thereto.

A further preferred feature is that one set of the passages includes supports. This is advantageous especially when the media in heat exchange have different pressures and those parts of the ceramic body separating adjacent passages must be stiffened in order to resist collapse. Stiffening can also be achieved by forming the passages as slots of curved or undulatory form in transverse cross-section.

The present heat exchanger can be adapted to previously existing spatial forms, if space is at a premium, in that the cover walls need not be planar but can be respectively concave and convex in transverse cross-section. End walls and/or side walls of the ceramic body preferably include grooves and tongues into which tongues and grooves formed on similar neighbouring heat exchangers can fit. This formation of the heat exchangers renders possible their assembly into larger construction units, the play between the tongues and grooves being selected so that there is substantially no undesirable stress even at working temperature. A plurality of heat exchangers may be secured together in parallel to present common inlet and outlet openings. If the ceramic body is of shell form, the cover walls not being planar, securing a plurality of similar ceramic bodies together can lead to a sleeve-like heat exchanger assembly. At the mounting points of the heat exchangers with each other, and with other elements such as inlet and outlet conduits, resilient layers of gas-tight ceramic fibre material are preferably provided to compensate for differing thermal expansions experienced on heating.

One method of producing the present heat exchangers, which is important especially for the individual manufacture of special heat exchangers, comprises milling said sets of passages from opposed faces of a partially-complete isostatically-compressed ceramic green body, which before being fired is completed by providing end walls and cover walls of said ceramic green body, parts of the cover walls being omitted to present said openings for permitting flow, in use, of heat exchange media therethrough.

A simpler method of producing the present heat exchangers, however, comprises extruding ceramic composition through an extrusion nozzle whose exit includes core bodies arranged to form said sets of passages, the extruded composition being cut to length and pre-fired before the form of the ceramic body is completed by providing end walls as well as by removing parts of said cover walls to present said opensings for permitting flow, in use, of heat exchange media therethrough, the ceramic body finally being fired.

Several embodiments of heat exchangers according to the present invention, and methods of producing them, will now be described, by way of example only, with reference to the accompanying drawings, in which.

As appears from the drawings, a heat exchanger according to the present invention is formed entirely of ceramic material as a body defining a plurality of elongate flow passages 1, 2 closed at their ends and arranged in a parallel staggered relationship to one another.

Figure 1:
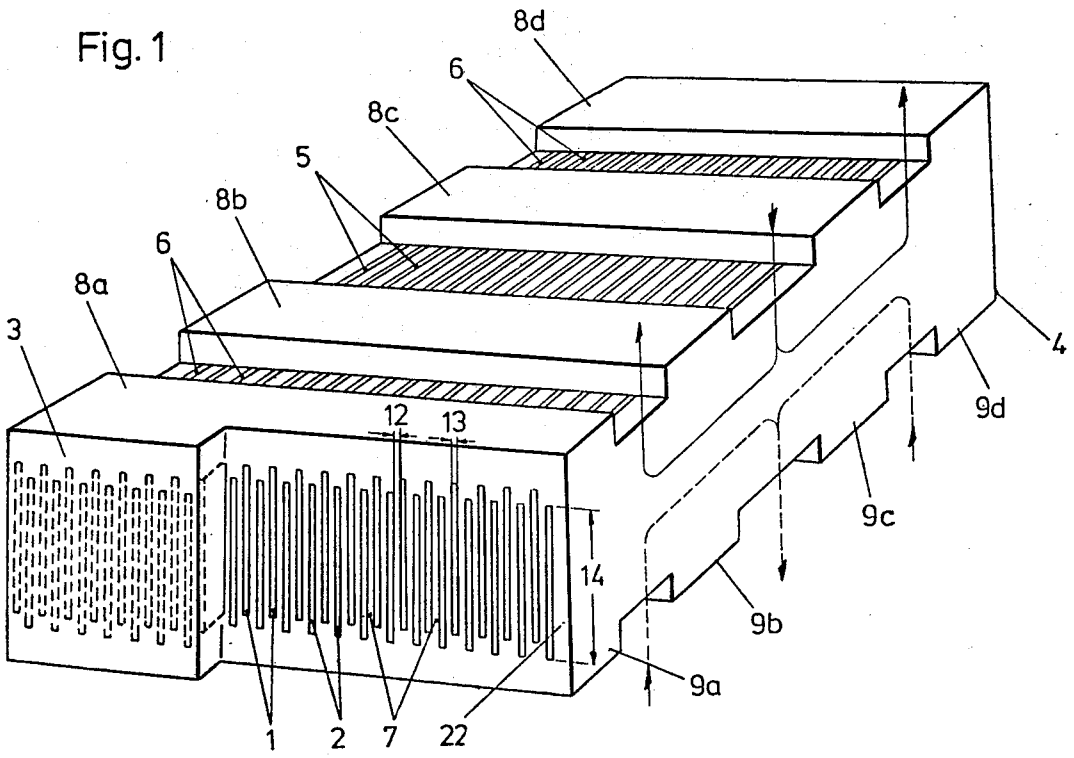
FIG. 1 is a perspective view of a heat exchanger produced by extrusion.
Figure 2:
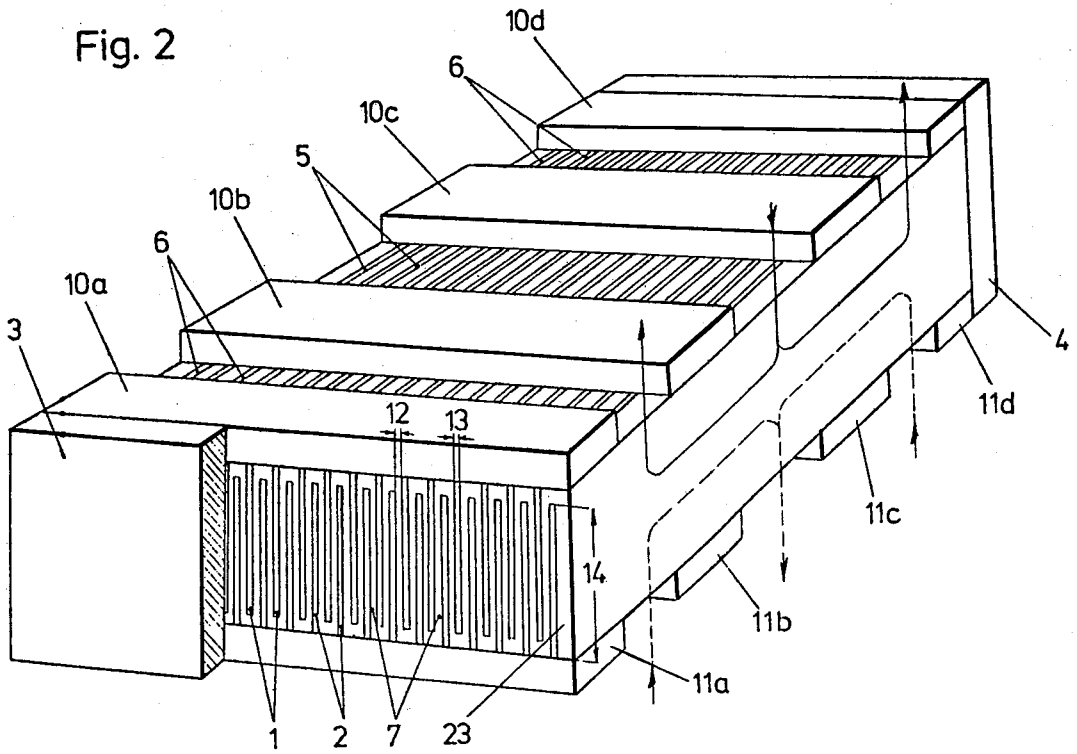
FIG. 2 is a perspective view of a heat exchanger with milled passages.

The flow passages 1, 2 are made more clearly visible in FIGS. 1 and 2 in cutaway sections through the nearer of end walls 3, 4 of the heat exchangers. The heat exchangers are connected to inlet and outlet conduits for two heat exchange media preferably in such a way that said media flow in counter-current. The inlet and outlet conduits are not illustrated in the drawings, but in FIGS. 1, 2 and 3 flow lines for the media are entered. The hot medium to be cooled (solid flow line) enters the flow passages 1 through a single inlet opening 5 and departs from the flow passages 1 through a pair of outlet openings 6. The cold medium to be heated (broken flow line) flows in counter-current. In the perspective views of FIGS. 1, 2 and 3 inlet and outlet openings for the flow passages 2 are situated on the undersides of the heat exchangers directly opposite to the inlet and outlet openings 5, 6.

The flow passages 1, 2 are arranged adjacently and parallel with one another to form individual chambers for the heat exchanger matrix. Heat transmission takes place through partitions 7 between neighbouring flow passages. The end walls 3, 4 gas-tightly close the ends of the flow passages 1, 2—but the reader should note that each end wall may not necessarily be applied as a single layer but as individual pieces closing each passage separately. The flow passages 1, 2 are covered along their lengths on both sides of the heat exchanger matrix by cover walls, the individual parts of which are designated by 8*a*, 8*b*, 8*c*; 9*a*, 9*b*, 9*c*, (FIG. 1) and 10*a*, 10*b*, 10*c*; 11*a*, 11*b*, 11*c* (FIG. 2).

Between the parts of the cover walls there are the inlet and outlet openings for the flow passages 1, 2. The flow passages 1, 2 are arranged offset in relation to one another by pairs. Hence, for FIGS. 1 and 2, the flow passages 1 protrude upwards towards the top cover walls further than the flow passages 2 adjacent to them, while the flow passages 2 protrude downwards beyond the flow passages 1 further towards the lower cover walls. The amount by which the flow passages protrude corresponds at least to the thickness 12 of one of the partitions 7. Due to this formation, the ceramic body viewed in a transverse cross-section has a somewhat serpentine course, as shown especially clearly in FIG. 4 (discussed below).

At the points where openings for the heat exchange media are to be provided, the cover walls are absent so that those flow passages which protrude beyond their adjacent flow passages towards the areas of absent cover wall are open. In the embodiment of FIG. 1 parts of the cover walls are removed by milling; in the embodiment of FIG. 2 the cover wall pieces are arranged in such a way that they leave the openings uncovered.

In other words, the flow passages 1 can be regarded as one set of alternate passages extending along their lengths closer towards one cover wall, and the flow passages 2 can be regarded as the other set of alternate passages extending closer towards an opposed cover wall of the ceramic body. As it is necessary for each set of passages to have at least an inlet and an outlet, for permitting two heat exchange media to flow through said respective sets of passages in use, the minimum requirement is that at least two transversely-extending parts of each of said opposed pair of cover walls is absent to expose only that set of passages closer thereto. Preferably, however, each of the cover walls presents three openings in the manner described above. With the counter-current heat exchangers of FIGS. 1, 2 and 3, the middle regions are hot and the end regions are cold, thermal stresses thereby being compensated.

Each of the flow passages 1, 2 is formed as a slot, preferably whose width 13 is small in comparison with its height 14. They are so arranged that the faces of major area overlap those of the adjacent slots. In this way large heat exchange areas for the media in heat exchange are produced in the heat exchanger matrix. Stiffening of the heat exchanger matrix is achieved by making side walls 17, 19 (FIG. 3) and side walls 22, 23 (FIGS. 1, 2 respectively) stouter than the partitions 7 between the flow passages.

Figure 3:
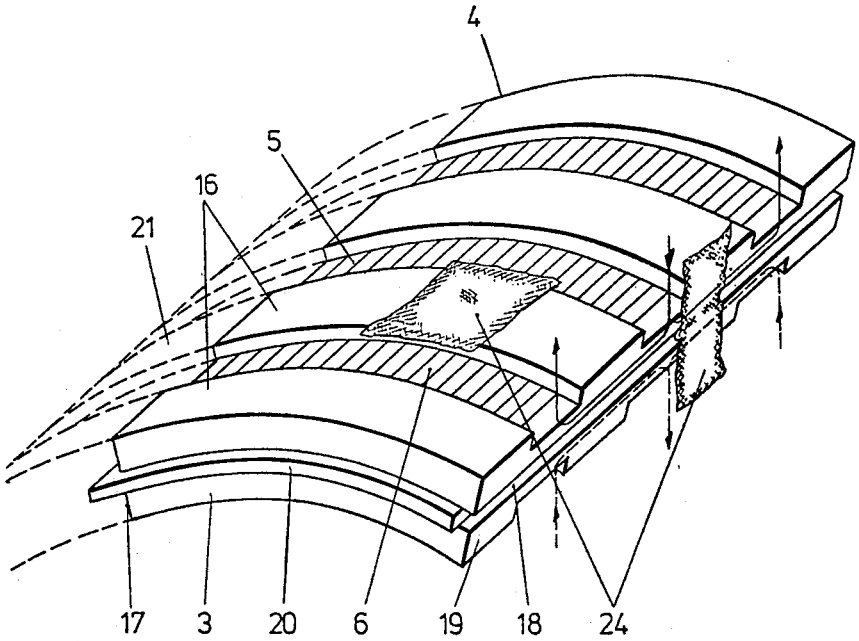
FIG. 3 is a perspective view of a heat exchanger with cover walls curved in shell form.

In FIG. 3 there is shown a heat exchanger with cover walls 16 curved in shell form, the cover walls thus being respectively concave and convex in transverse cross-section. In order that several similar heat exchangers may be attached to one another, the heat exchanger of FIG. 3 has grooves 18 on its side wall 19 and its end wall 4, and has tongues 20 on its other side wall 17 and its end wall 3. Corresponding tongues and grooves of further heat exchangers can be fitted with clearance into these grooves 18 and tongues 20. In FIG. 3 only one further similar heat exchanger 21 is reproduced in chain lines. It is especially advantageous to interconnect a plurality of the heat exchangers of FIG. 3 in parallel to form a hollow sleeve-like body having common inlet and outlet openings. The conduits for the media in heat exchange may then be generally coaxial therewith. At bearing points between mutually attached heat exchangers, and between heat exchangers and adjoining non-ceramic elements, there are resilient layers 24 which protect the heat exchangers against mutual mechanical damage, and also compensate for different thermal expansions between the heat exchangers and the non-ceramic elements, the layers 24 preferably being formed of gas-tight ceramic fibre material.

Figure 4:
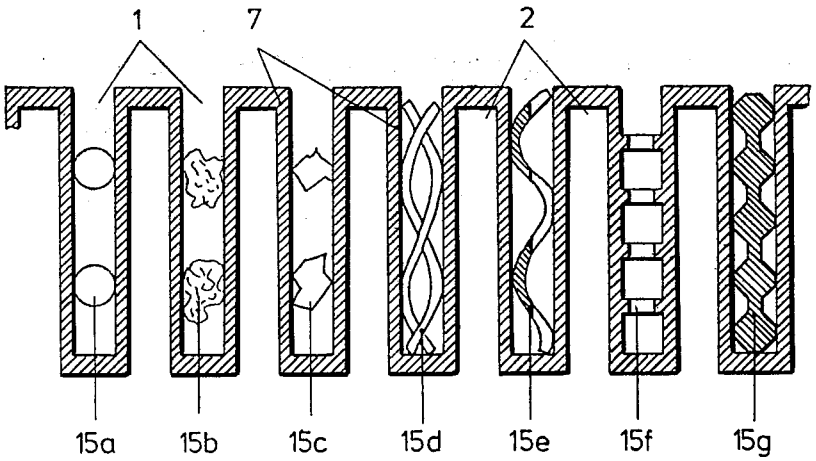
FIG. 4 is a schematic transverse cross-section showing various supports stiffening one set of the passages; and, FIG. 5 shows schematically an extruder nozzle with core pieces for use in forming heat exchangers by extrusion.

In FIG. 4, a transverse cross-section shows the serpentine course of the ceramic body on a greatly enlarged scale. Between the partitions 7 different supports 15 are inserted in the flow passages 1. Supports between the partitions 7 are very desirable when the two media in heat exchange have different pressures. The supports 15 are fitted in those flow passages which conduct the medium having the lower pressure. Variously shaped bodies and various materials can be used as the supports 15. By way of example, balls 15*a*, foamed materials 15*b*, grains 15*c*, intertwined parts 15*d* and mutually cross-linked parts 15*e* can be inserted between the partitions 7. As other alternatives, the inner walls of the passages may be ribbed as shown at 15*f*, or a corrugated insert may be provided which, as shown at 15*g*, has the effect of forming several separated passages in each individual flow passage. The balls and grains are naturally distributed in as uniform a manner as possible. Ceramic materials, but also graphite, are especially suitable materials for the supports 15, the grains 15*c* in fact consisting of graphite.

Figure 5:
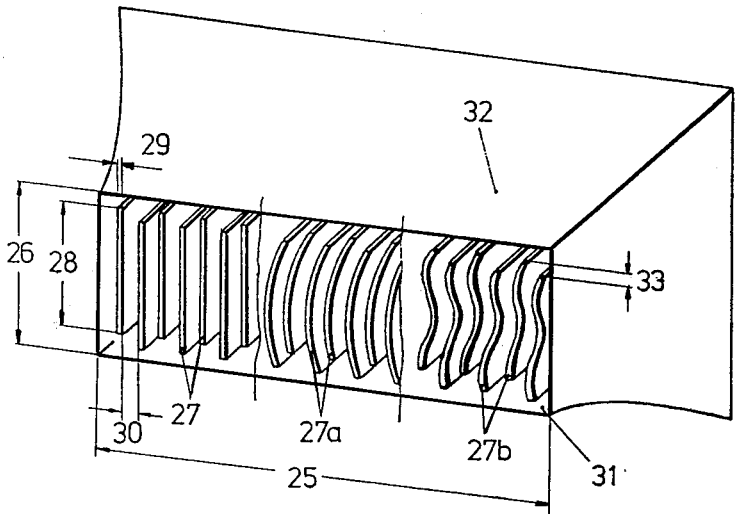

Ceramic heat exchangers according to FIG. 1 or 3 are advantageously produced by extrusion of ceramic composition by means of an extruder. FIG. 5 shows an embodiment of a suitable extruder nozzle, the exit cross-section of which has width 25 and height 26 corresponding to the desired external dimensions of the heat exchanger. Within the exit cross-section, there are arranged several core bodies 27 of rectangular cross-section, the height 28 of which is far greater than their width 29. The core bodies 27 are arranged side-by-side with spacing 30 in a row so that the larger surfaces of the core bodies 27 overlap one another. The dimensions of the core bodies determine the subsequent cross-sections of the flow passages 1, 2 of the ceramic heat exchanger.

The core bodies 27 are secured to the entry side of the extruder nozzle. They protrude in free-standing manner into the exit cross-section and are staggered by pairs in such a manner in relation to one another that each core body protrudes beyond the neighbouring core body closer towards the lower or upper wall 31, 32 (as illustrated) of the extruder nozzle. The individual core bodies protrude beyond their neighbouring core bodies by an amount 33 which corresponds at least to the distance 30 between adjacent core bodies.

If ceramic composition is forced by an extruder, which is not illustrated in FIG. 5, through the exit cross-section of the extruder nozzle, a continuous green body extrusion with elongate flow passages is produced. The green body extrusion is cut to length and pre-fired. The cover walls are then milled away at the points where inlet and outlet openings are to be formed. The cover walls are removed to depth which allows only one set of the flow passages to be opened. At the ends the flow passages are closed with ceramic composition. Then the heat exchanger is finally fired.

Differently shaped core bodies can be used in the extruder nozzle. In FIG. 5, beside the core bodies 27 of rectangular cross-section, by way of example there are also illustrated arcuately curved core bodies 27*a* and core bodies 27*b* of undulatory form. In pressing a ceramic composition through an extruder nozzle with such core bodies, heat exchangers having curved or undulatory flow passages are produced, which are preferable on account of their higher rigidity in comparison with flow passages of rectangular cross-section, especially when there are high pressure differences between the media in heat exchange.

Heat exchangers according to FIG. 2 are expediently produced from partially-complete isostatically-compressed ceramic green bodies. Here, starting from two plane-parallel opposed faces, apertures of slot form for the flow passages of the heat exchanger are milled into the ceramic body, the arrangement of the flow passages being as discussed hereinbefore. The flow passages are then covered with cover walls, the individual parts of the cover walls being arranged to define the inlet and outlet openings for the flow passages. The ends of the flow passages, which are open after milling, are filled out with ceramic green composition. After the final firing, therefore, the heat exchanger is gas-tightly closed at its ends.

Heat exchangers according to the present invention are especially suitable for heat exchange between media at high temperature. Furthermore, the heat exchangers can allow relatively large heat exchanger assemblies for higher heat exchange performances to be produced in a simple manner from individual heat exchangers according to the modular principle.

What we claim is:

1. A heat exchanger comprising a ceramic body having opposite cover walls; the body having a plurality of elongate flow passages therein which are closed at their ends, the flow passages extend between their ends generally along the direction of extension of the cover walls; the flow passages being arranged in a parallel to each other and in an interleaved relationship, wherein each flow passage has and is defined between opposed side walls thereof which side walls extend toward the cover walls, and the respective side walls of adjacent interleaved passages being disposed and of such length that they overlap the respective side walls of the passages adjacent thereto; the interleaved passages having a staggered relationship to one another, wherein one set of alternate interleaved passages extend along their lengths closer toward one of the cover walls, and the other set of alternate interleaved passages extend closer toward the opposite cover wall of the ceramic body; at least two transversely extending parts of each of the cover walls being absent to expose and permit access through the cover walls to only that set of the passages closer thereto, thus presenting a total of at least four openings for permitting fluid flow of two heat exchange media to flow through respective ones of the two interleaved sets of passages.

2. A heat exchanger according to claim 1, in which one set of the passages includes supports for resisting collapse of the ceramic body.

3. A heat exchanger according to claim 1, in which each of the passages is formed as a slot having the side walls and each of the slot side walls is of curved form in transverse cross-section.

4. A heat exchanger according to claim 1, in which each of the cover walls presents three openings, one set of the passages having two inlets and a single outlet located therebetween, and the other set of the passages having two outlets and a single inlet located therebetween.

5. A heat exchanger according to claim 1 whose cover walls are respectively concave and convex in transverse cross-section.

6. A heat exchanger according to claim 1, in which the ceramic body has walls other than the cover walls which are formed with one of tongues and grooves for allowing location, in use, with corresponding grooves and tongues formed on similar neighboring heat exchangers.

7. A heat exchanger according to either of claims 1 or 5, in which a resilient layer of gas-tight ceramic fiber material is carried on the ceramic body for bearing, in use, against some other element.

8. A plurality of heat exchangers according to claim 1 which are secured together in parallel in manner and at an orientation parallel to present common inlet and outlet openings.

9. A heat exchanger according to claim 1 in which each of the passages is formed as a slot having the side walls and each of the slot side walls is of undulatory form in transverse cross-section.

10. A heat exchanger according to claim 1, wherein adjacent interleaved flow passages share a respective common side wall between them along the portion of the adjacent passages which overlap in the direction between the opposite cover walls.

11. A heat exchanger according to claim 1, wherein each flow passage protrudes beyond the corresponding ends of the adjacent flow passages toward the respective cover wall to which that flow passage is closer over a distance of at least the space between adjacent passages.

* * * * *